United States Patent [19]

Ito

[11] Patent Number: 4,950,943

[45] Date of Patent: Aug. 21, 1990

[54] SUPPORT FOR SHADOW MASK IN A CATHODE RAY TUBE

[75] Inventor: Hideya Ito, Nagaokakyo, Japan

[73] Assignee: Mitsubishi Denki Kabushiki Kaisha, Tokyo, Japan

[21] Appl. No.: 278,740

[22] Filed: Dec. 2, 1988

[30] Foreign Application Priority Data

Dec. 3, 1987 [JP] Japan ..... 62-308067

[51] Int. Cl.[5] ..... H01J 29/07

[52] U.S. Cl. ..... 313/404; 313/406

[58] Field of Search ..... 313/404, 406, 407

[56] References Cited

U.S. PATENT DOCUMENTS

| | | | |
|---|---|---|---|
| 3,454,813 | 7/1969 | Lewinsen | 313/406 X |
| 3,803,436 | 4/1974 | Morrell . | |
| 4,300,071 | 11/1981 | Dougherty et al. | 313/407 |
| 4,335,329 | 6/1982 | Fukuzawa et al. | 313/406 |
| 4,659,958 | 4/1987 | D'Amato | 313/406 |

*Primary Examiner*—Donald J. Yusko

[57] ABSTRACT

A shadow mask mounting in a cathode ray tube includes an evacuated envelope including a funnel section, a cylindrical neck section and a faceplate of generally cup-shaped configuration, including a screen plate and a side wall perpendicular to the screen plate. The shadow mask mounting includes a shadow mask assembly including a rigid support frame and a finely perforated shadow mask mounted across the support frame, a plurality of generally elongated support members distributed around the support frame, stud pins each provided in the faceplate for anchoring one end of each support member to the side wall of the faceplate, and a generally elongated resilient member provided for each of the support members. The resilient member is for applying a biasing force, acting in a direction radially outwardly of the shadow mask, to the respective support member. Each of the support members is secured at one end to the support frame and at the other to the side wall of the faceplate whereas the resilient member has one end secured to the support frame.

48 Claims, 4 Drawing Sheets

SUPPORT FOR SHADOW MASK IN A CATHODE RAY TUBE

BACKGROUND OF THE INVENTION

1. Field of the Invention

The present invention generally relates to a color cathode ray tube and, more particularly, to the mounting of the shadow mask in the color cathode ray tube.

2. Description of the Prior Art

It is well known that a color cathode ray tube utilized as a display of, for example, a television receiver set employes a generally rectangular shadow mask assembly which is made of a perforated thin metallic plate or foil. The perforated thin metallic plate or foil has a multiplicity of minute circular apertures defined therein in a pattern coresponding to the triads of primary color elemental phosphor dots on the inner surface of the faceplate. Each of the triads correspond to the number of the primary colors.

When it comes to the manner by which the rectangular shadow mask is supported inside the evacuated envelope in the vicinity of the luminescent phosphor-deposited screen, a generally L-sectioned, generally rectangular rigid support frame is employed so as to intervene between the periphery of the shadow mask and the envelope.

More specifically, as shown in FIG. 1 of the accompanying drawings, the shadow mask is identified by 1. The envelope (not shown) comprises a funnel section (not shown) closed at one end by a generally cylindrical neck section (not shown) and at the other end by a generally rectangular faceplate 5. The rectangular faceplate 5 is generally in the form of a cup-shaped envelope cap including a screen plate 5*a* and a side wall 5*b* which is sealed to the funnel section. The screen plate 5*a* has an inner surface thereof deposited with triads of phosphor dots in a pattern corresponding to the pattern of the minute circular apertures in the shadow mask 1.

The generally L-shaped sectioned support frame is identified by 2 and has an axial flange 2*a*, which protrudes towards the screen plate 5*a* in a direction parallel to the longitudianl sense of the envelope. It further contains a radial flange 2*b* which extends generally perpendicular to the axial flange 2*a* and is retained in position within the envelope with the axial flange 2*a* thereof, connected to the side wall 5*b* of the faceplate 5. The shadow mask 1 is telescoped over and welded to the axial flange 2*a* of the support frame 2 while confronting, and spaced a predetermined distance inwardly from, the screen plate 5*a*.

As clearly shown in FIG. 1, the connection between the support frame 2 and the side wall 5*b* of the faceplate 5 is made by the use of a frame support structure 7 which comprises four stud pins 6, a bimetal piece 3 employed for each stud pin 6. It further comprises a leaf spring member 4 which is also employed for each stud pin 6. The stud pins 6 are embedded or otherwise permanently attached to the side wall 5*b* of the faceplate 5, and the four bimetal pieces 3 are rigidly secured or otherwise welded to the support frame 2 and distributed around the support frame 2. The leaf spring members 4 have one end 4*a* welded to the associated bimetal pieces 3. The other end 4*b* is formed with respective through-holes for the passage of the associated stud pins 6 therethrough for the connecting of the leaf spring members 4 to the side wall 5*b* of the faceplate 5.

When the color cathode ray tube, wherein the shadow mask 1 is supported within the envelope through the support frame 2 by way of the frame support structure 7 in the manner as hereinabove described, is operated, about 80% of the elctron beams, emitted from an electron gun assembly housed within the neck section of the envelope, impinge upon the shadow mask 1 and a portion of the support frame 2. Impingement of the electron beams upon the shadow mask and a portion of the support frame 2 results in an increase of temperature of the shadow mask mounting system as a whole. For example, in the case of the color cathode ray tubes generally used in commercially available television receiver sets, the amount of increase of the temperature of the shadow mask mounting system may be about 50° at a central region of the shadow mask 1 and about 20° at that portion of the support frame 2 and the frame support structure 7.

As is well known to those skilled in the art, increase of the temperature of the shadow mask support system as a whole brings about a displacement of the shadow mask 1 relative to the shadow mask support system as will now be discussed in details with particular reference to FIGS. 2 to 4.

Since the increase of temperature generally starts from the shadow mask 1, the temperature of the shadow mask 1 increases within a short length of time subsequent to the start of operation of the color cathode ray tube. Once the shadow mask 1 is consequently heated, the shadow mask 1 expands by reason of thermal effects so as to displace, as shown by the phantom line 1*a* in FIG. 2(*a*), in a direction close towards the screen plate 5*a* and generally parallel to the longitudinal axis Z of the evacuated envelope. With the subsequent passage of time, the support frame 2 is also heated and equally expands by reason of thermal effects to such an extent that, as shown by the respective phantom lines 1*b* and 2*c* in FIG. 2(*b*), both the shadow mask 1 and the support frame 2 displace not only in an X-axis direction perpendicular to the longitudinal axis Z of the evacuated envelope, but also in a Y-axis direction which is perpendicular to both of the longitudinal axis Z of the evacuated envelope and the X-axis direction.

In other words, when the shadow mask 1 is first heated, the shadow mask 1 is thermally expanded so as to result in an axial deformation or a 'doming' in which a major portion of the shadow mask 1 protrudes towards the screen plate 5*a* as shown in FIG. 2(*a*). Subsequently, when the support frame 2 is heated by reason of thermal effects occasioned by the impingement of the electron beams and also by the heat transmission from the shadow mask 1, not only does the shadow mask 1 expand in a radial direction generally perpendicular to the longitudinal axis Z of the evacuated envelope, but the support frame 2 is also deformed in the radial direction as shown in FIG. 2(*b*). This results in a landing drift, which is a complex deformation including the dooming of the shadow mask 1.

In any event, once one or both of the shadow mask 1 and the support frame 2 are so displaced, the misalignment of the apertures in the shadow mask with the primary color elemental phosphor dots on the screen plate 5*a* occurs. This causes mislanding of the electron beams upon phosphor dots on the screen plate 5*a*. This in turn results in reduction of the color purity allowance and also in deterioration of the color purity.

As hereinabove discussed, the major cause of the landing drift is the thermal expansion of both of the support frame 2 and the shadow mask 1 in the X-axis and Y-axis directions. The bimetal pieces 3 used in the prior are mounting system discussed with reference to FIG. 1 are employed for the purpose of minimizing the landing drift (See U.S. Pat. No. 3,803,436.). Specifically, with the use of the bimetal pieces 3, the landing drift can be minimized by causing the shadow mask 1 and the support frame 2 to move towards respective positions, shown by the respective phantom lines 1*c* and 2*d* in FIG. 2(*c*), close to the screen plate 5*a* in a direction generally parallel to the longitudinal axis Z of the evacuated envelpe as the temperature of the mounting system as a whole increases.

The prior art attempt to minimize the landing drift places emphasis on the correction in a direction parallel to the longitudinal axis Z of the evacuated envelope. No substantial consideration has been paid to eventual effects brought about by the difference in thermal expansion between the support frame 2 and the frame support structure 7, because, where the support frame 2 is made of iron and the leaf spring members 4 are made of stainless steel, the difference in coefficient of thermal expansion is about $1.5\times10^{-6}/°$ C. Further, this occurs because, if the amount of increase of the temperature of one or both of the support frame 2 and the leaf spring members 4 is assumed to be 20° and the effective length of each leaf spring member 4 is assumed to be 50 mm, the amount of displacement of the support frame 2 will be about 1.5 micrometers, which is tolerable.

However, when material of low coefficient of thermal expansion such as a metallic alloy containing, as a principle component, iron and nickel, is employed as a material for the shadow mask 1 and the sopport frame 2 for the purpose of minimizing the dooming of the shadow mask 1, the use of the leaf spring members 4 made of stainless steel will eventually result in a displacement of the support frame 2 of about 12 micrometers, or of about 30 micrometers when the ambient temperature subsequently elevates, under a condition identical with that described above.

In such case, the actual amount of displacement varies depending on the manner by which the support frame 2 is fitted to the side wall 5*b* of the faceplate 5. However, if the frame support structure 7 is so structured and so configured that, as shown in FIG. 3, the leaf spring members 4 may be oriented in the same direction around the periphery of the support frame 2, the displacement of the support frame 2 in a direction, shown by C, circumferentially thereof, which is occasioned by the elevation of the temperature, results in a twist of the support frame 2 and, hence, the shadow mask 1 in a direction about the longitudinal axis Z of the evacuated envelope as shown by the arrow A in FIG. 3.

If in order to minimize the twist of the support frame two of the leaf spring members 4 which are, on respective lateral sides of the support frame 2 adjacent the shorter sides of the rectangular shape of the support frame 2, are oriented in the same direction as shown in FIG. 4, e.g., downwards as viewed in FIG. 4, the difference of elongation between the support frame 2 and the frame support structure 7 will result in a shift of the support frame 2 and, hence, the shadow mask 1 not only in a direction shown by B, e.g. downwards as viewed in FIG. 4, in a plane perpendicular to the longitudinal axis Z of the evacuated envelope and containing the X- and Y-axes, but also in a direction parallel to the longitudianl axis Z of the evacuated envelope.

As discussed above, tthe displacement of only the support frame 2 is accompanied by a corresponding displacement of the shadow mask 1 which in turn brings about the reduction in color purity of the color cathode ray tube.

In general, in the case of the high resolution color cathode ray tube of 21 inch, 0.3 dot pitch model, the tolerance of color brightness is about 25 micrometers and the tolerance of color purity is about 40 micrometers. Therefore, even though other affecting factors are taken into consideration, the amount of color misalignment which would result from the thermal expansion of the support frame 2 relative to the frame support structure 7 has to be restricted to 5 micrometers or smaller. Since the movement of the shadow mask 1 in the plane containing the X- and Y-axes is projected on the phosphor-deposited screen on the inner surface of the screen plate 5*a*, the difference in coefficient of thermal expansion between the support frame 2 and the frame support structure 7 must be $2\times10^{-6}/°$ C. or smaller. This allows for the amount of movement of the shadow mask 1 projected on the phosphor-deposited screen to be restricted to 5 micrometers or smaller.

It is pointed out that, if in the construction shown in FIG. 4 the leaf spring members 4 are made of the same material as that for the support frame 2, that is, the material of low coefficient of thermal expansion such as the Fe-Ni alloy, the displacement resulting from the difference in thermal expansion might be substantially eliminated. However, the material of a low coefficient of thermal expansion utilizing the Fe-Ni alloy tends to exhibit a low elasticity and will loose the elasticity when heated, as is occasioned during the manufacture of the color cathode ray tube. Therefore, once some or all of the leaf spring members 4 made of such material as hereinabove described loose the elasticity, they will no longer serve to retain the shadow mask assembly in position within the evacuated envelope, particularly, within the space delimited by the side wall 5*b* of the faceplate 5.

SUMMARY OF THE INVENTION

The present invention has accordingly been devised with a view to substantially eliminating the above discussed problems inherent in the prior art shadow mask mounting systems. It is further intended to provide an improved shadow mask mounting system wherein both of the shadow mask and the support frame are made of material having a low coefficient of thermal expansion effective to minimize the landing drift and also to retain the shadow mask assembly accurately in position within the evacuated envelope substantially at all times.

In accordance with the present invention herein disclosed, there is provided a shadow mask mounting in a cathode ray tube which includes an evacuated envelope having a longitudinal axis, including a funnel section closed at one end by a generally cylindrical neck section and at the other end by a faceplate of generally cup-shaped configuration. The faceplate includes a screen plate, lying generally perpendicular to the longitudinal axis, and a side wall protruding generally parallel to the longitudinal axis and sealed to the funnel section. The shadow mask mounting includes a shadow mask assembly including a rigid support frame and a finely perforated shadow mask mounted across the support frame. It further includes a plurality of generally elongated support members distributed around the support frame, a device provided in the faceplate for anchoring one end of each support member to the side wall of the faceplate, and a generally elongated resilient member provided for each of the support members for applying a biasing force, acting in a direction radially outwardly of the shadow mask, to the respective support member. Each of the support members is secured at one end to the support frame and at the other to the side wall of the faceplate, whereas the resilient member has one end secured to the support frame.

Preferably, the shadow mask, the support frame and the support members are all made of a metallic material having a coefficient of thermal expansion equal to or lower than $4\times10^{-6}/°$ C., and the difference in coefficient of thermal expansion between the support frame and the support members is equal to or smaller than $2.0\times10^{-6}/°$ C.

BRIEF DESCRIPTION OF THE DRAWINGS

In any event, the present invention will become more clearly understood from the following description of preferred embodiments thereof, when taken in conjunction with the acompanying drawings. However, the embodiments and the drawings are given only for the purpose of illustration and explanation, and are not to be taken as limiting the scope of the present invention in any way whatsoever, which scope is to be determined solely by the appended claims. In the drawings, like reference numerals denote like parts in the several views, and:

Figure 2A:
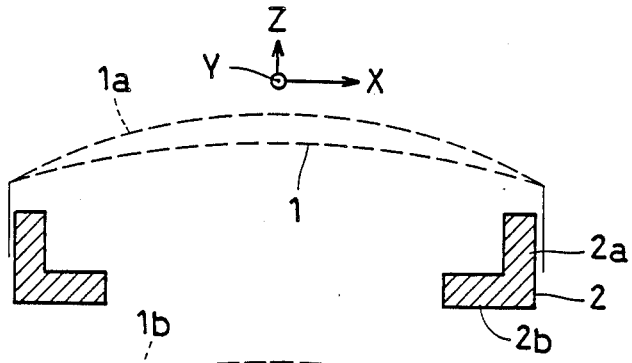
Fig. 2(a) Prior Art
Figure 2B:
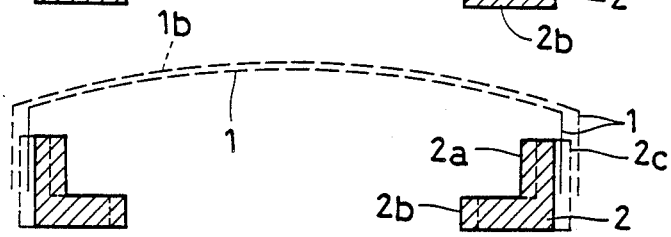
Fig. 2(b) Prior Art
Figure 2C:
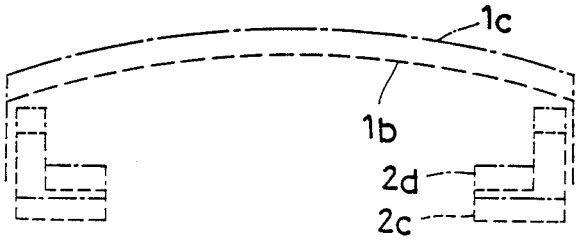
Fig. 2(c) Prior Art
Figure 3:
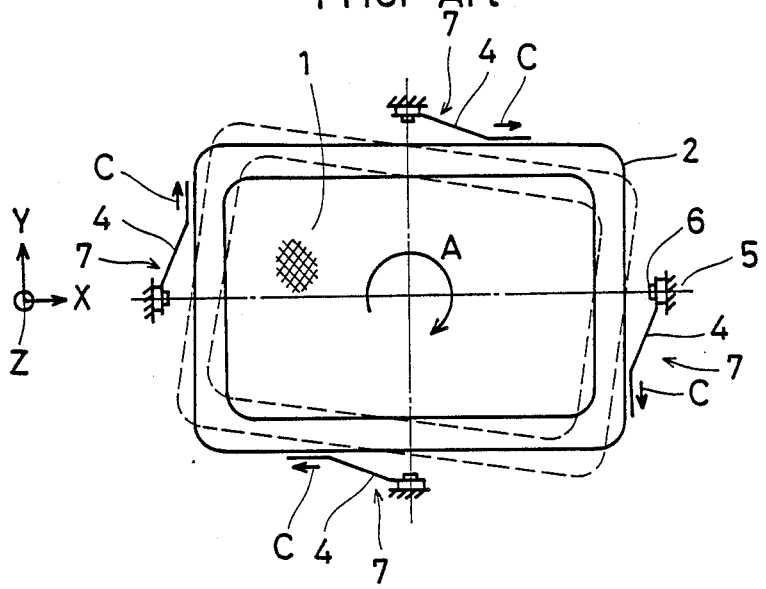
Fig. 3 Prior Art
Figure 4:
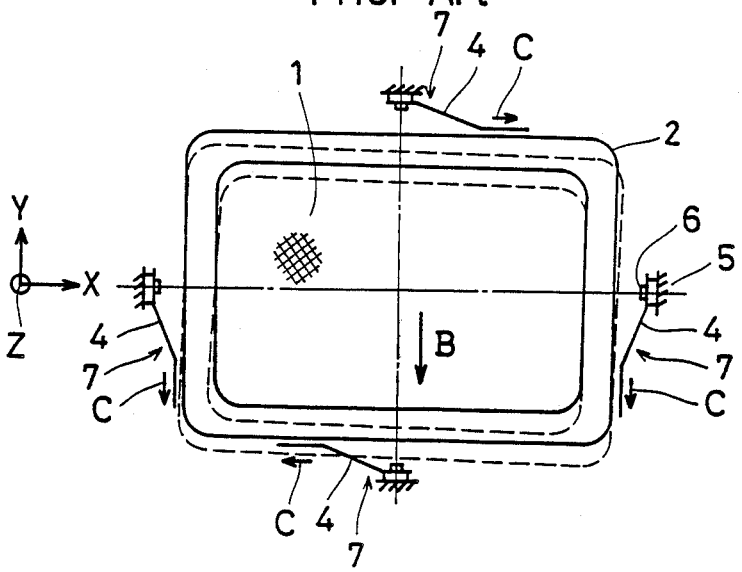
Fig. 4 Prior Art
Figure 5:
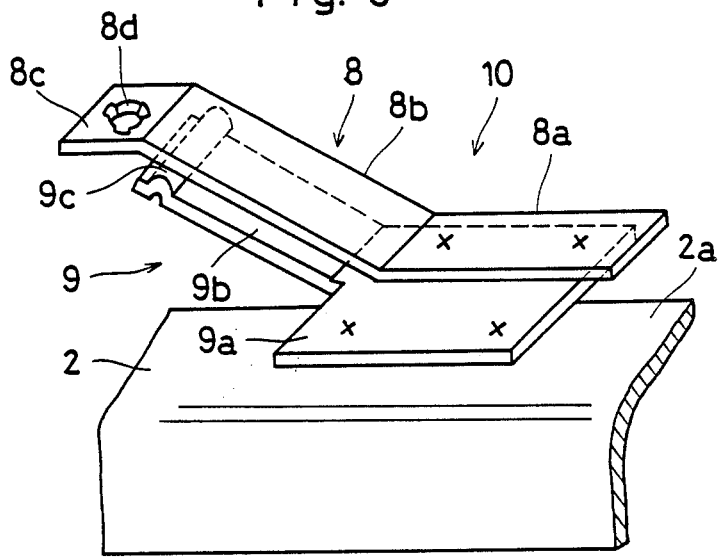
Figure 6:
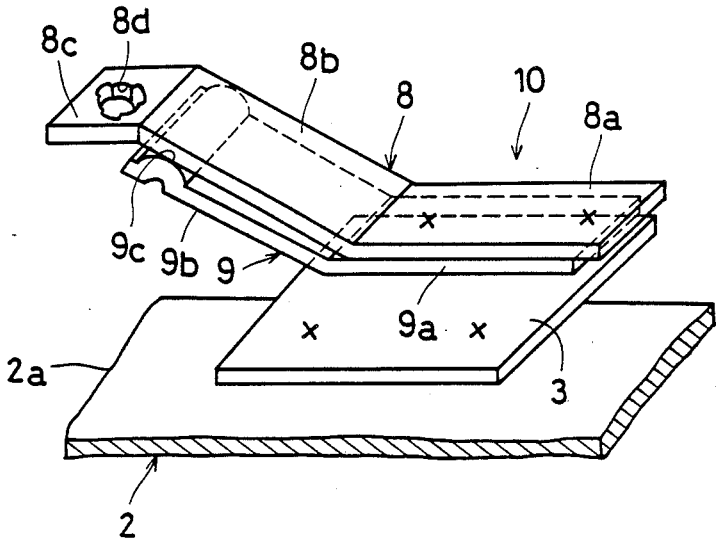
Figure 7:
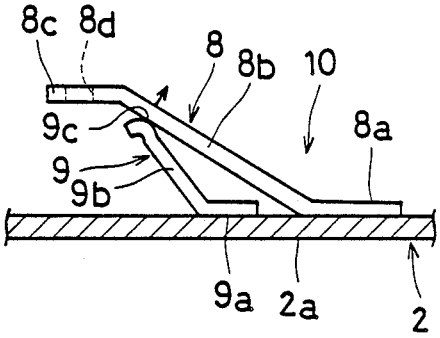
Figure 8:
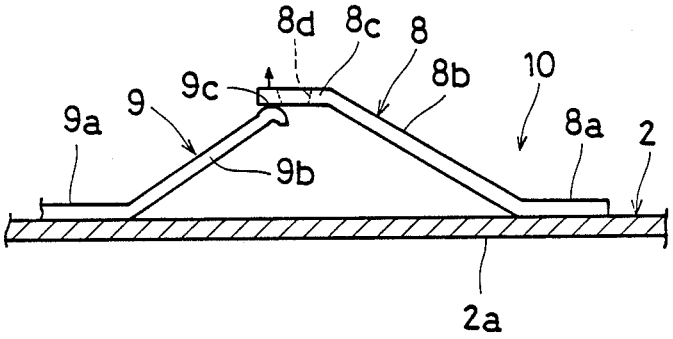
Figure 9:
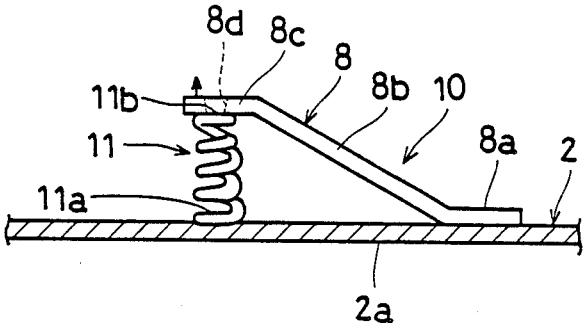

FIG.s 2(*a*) and 2(*b*) are schematic sectional views showing how the shadow mask and the support frame in the prior art shadow mask mounting system are displaced when the shadow mask is heated and when both of the shadow mask and the support frame are heated, respectively;

FIG. 2(*c*) is a view substantially similar to FIG. 2(*b*), showing the displacement of both of the shadow mask and the support frame when bimetal pieces are employed according to the prior art shadow mask mounting system;

FIGS. 3 and 4 are elevational views showing the different manners in which the shadow mask is displaced when the support frame undergoes a thermal expansion, respectively, according to the prior art shadow mask mounting system;

FIG. 5 is a perspective view showing a frame support structure according to a preferred embodiment of the present invention;

FIG. 6 is a view similar to FIG. 5, showing another preferred embodiment of the present invention; and FIGS. 7 to 9 are sectional views showing the frame support structure according to further preferred embodiments of the present invention, respectively.

DETAILED DESCRIPTION OF THE EMBODIMENTS

In describing the preferred embodiments of the present invention, reference will be made to the color cathode ray tube having a generally rectangular screen, although the present invention can be equally applicable to the cathode ray tube having the screen of any shape, for example, of a circular shape.

The highly evacuated envelope, although not shown, comprises a funnel section closed at one end by a generally cylindrical neck section and at the other end by a generally rectangular faceplate. As is the case with the faceplate 5 shown in FIG. 1, the rectangular faceplate is generally in the form of a cup-shaped envelope cap including a screen plate and a side wall which is sealed to the funnel section. The screen plate has an inner surface thereof deposited with triads of phosphor dots in a pattern corresponding to the pattern of the minute circular apertures in the shadow mask.

In order for the rectangular shadow mask to be supported inside the evacuated envelope, particularly within the space delineated by the side wall of the faceplate, in the vicinity of the luminescent phosphor-deposited screen plate, a generally L-sectioned, generally rectangular rigid support frame is employed so as to intervene between the periphery of the shadow mask and the envelope. The L-sectioned support frame having an axial flange, protruding towards the screen plate in a direction parallel to the longitudinal sense of the envelope, and a radial flange extending generally perpendicular to the axial flange, is retained in position within the envelope with the axial flange thereof connected to the side wall of the faceplate. The shadow mask is telescoped over and welded to the axial flange of the support frame while confronting, and spaced a predetermined distance inwardly from, the screen plate.

The invention, in a first-preferred embodiment, will now be described referring to FIG. 5, in which only a portion of the axial flange 2*a* of the support frame 2 is illustrated. The connection between the support frame 2 and the side wall (shown by 5*b* in FIG. 1) of the faceplate is made by the use of a frame support structure 10, the details of which will now be described.

According to the first preferred embodiment of the present invention shown in FIG. 5, the support frame 2 is made of a metallic alloy of low coefficient of thermal expansion containing, as a principle component, 36% Ni and Fe. The frame support structure 10, so far as shown in FIG. 5, includes four stud pins (identified by 6 in FIG. 1), a generally elongated support strip 8 employed for each stud pin, and a generally elongated resilient member for each support strip 8. Although, in FIG. 5 as well as FIGS. 6 to 9, only one of the support strips 8 is shown for the sake of simplicity, the support strips 8 and the other component parts forming the frame support structure 10 are to be understood as distributed around the periphery of the support frame 2, that is, along the four sides of the rectangular shape of the support frame 2.

As shown in FIG. 5, the support stip 8 is made of the same material as that for the support frame 2 and has a first arm 8*a*, adapted to be connected to the axial flange 2*a* of the support frame 2 in a manner as will be described later in detail, a second arm 8*c* formed with a through-hole 8*d* for engagment with the corresponding stud pin 6 (See FIG. 1) and an intermediate body 8*b* extending between the first and second arms 8*a* and 8*c* and inclined relative to any one of the first and second arms 8*a* and 8*c*. The elongated resilient member is employed in the form of a leaf spring 9 made of stainless steel. This leaf spring 9 has one end 9*a* adapted to be secured to the axial flange 2*a* of the support frame 2 as will be described later, and an elongated resilient body 9*b* continued from the connecting end 9*a* thereof and formed at the opposite end with a presser protuberance 9*c* extending widthwise of the resilient body 9*b* for engagement with the intermediate body 8*b* of the support strip 8.

In the practice of the present invention, it is preferred that the metallic material for any one of the shadow mask 1, the support frame 2 and the support strips 8, is of a type having a coefficient of thermal expansion equal to or lower than $4\times10^{-6}/°$ C. However, the metallic material for the support frame 2 and that for each support strip 8 are preferred to have a difference in coefficient of thermal expansion which is equal to or smaller than $2.0\times10^{-6}/°$ C. in order for, as described in connection with the prior art, the amount of movement of the shadow mask 1 in the plane containing the X- and Y-axis to be restricted to 5 micrometers or smaller.

According to the embodiment shown in FIG. 5, first arm 8*a* of the support strip 8 rigidly connected by the use of any known welding technique, for example, a spot-welding technique, to the axial flange 2*a* of the support frame 2 with the connecting end 9*a* of the leaf spring 9 interposed between the first arm 8*a* of the support strip 9 and the axial flange 2*a* of the support frame 2. At this time, the presser protuberance 9*c* of the resilient body 9*b* of the leaf spring 9 is held in line contact with a portion of the intermediate body 8*b* of the support strip 8 adjacent the second arm 8*c*, urging the second arm 8*c* to exhibit a tendency to separate away from the axial flange 2*a* of the support frame 2.

After the support strips 8 and the corresponding resilient members 9 are mounted on the support frame 2 in the manner as hereinbefore described, the resultant shadow mask assembly including the shadow mask 1 (See FIG. 1) and the support frame 2 is mounted in the faceplate 5 with the stud pins 6 (FIG. 1) allowed to pass through the respective through-holes 8*d* in the second ends 8*c* of the support strips 8 while the resilient members 9 are held in prestressed condition. In this way, the shadow mask assembly is supported in position within the space delineated by the side wall 5*b* of the faceplate 5 in a manner substantially similar to that shown in FIG. 1.

In the case of the color cathode ray tube of 21-inch dot model, the support frame 2 has a wall thickness of 2.0 mm, each support strip has a wall thickness of 1.0 mm, and each resilient member has a wall thickness of 0.75 mm.

A series of experiments conducted by the inventors of the present invention have shown that, with no resilient members 9 employed, the initial spring pressure of 2.3 kg exhibited by each support strip 8 was lowered down to 0.2 kg when the support structure 7, without the resilient members, was heated during a baking process which is one of a number of processes performed during the manufacture of the cathode ray tube and is performed prior to a painting process. In contrast thereto, it has been demonstrated that, when the leaf spring 9 is employed for each support strip 8, the same initial spring pressure of 2.3 exhibited by each support strip 8 backed up by the associated leaf spring 9 was lowered only down to 1.4 kg after the paint baking process, with no further reduction in spring pressure observed even during the subsequent heat treatment.

Thus, if the initial spring pressure exerted by the resilient body 9*b* of each leaf spring 9 is chosen to be higher than a desired value, the spring pressure of the desired value can be transmitted from the resilient body 9*b* of the leaf spring 9 to the support strip 8 after the completion of the baking process. Accordingly, even though each support strip 8 is made of the material of low coefficient of thermal expansion, that is, the same material as that for the support frame 2, the support strip 8 backed up by the associated leaf spring 9 can exert a constant spring pressure at all times, even during the painting process and the subsequent manufacturing processes.

It is to be noted that, in the practice of the present invention, the use of the presser protuberance 9*c* shown and described as formed in each leaf spring 9 may not be always necessary. Further, the entire surface area of the resilient body 9*b* may be held in contact with the intermediate body 8*b* of the associated support strip 8. However, considering the possiblity that the presence of foreign matter trapped between the resilient body 9*b* of each leaf spring 9 and the intermediate body 8*b* of the associated support strip 8 may adversely affect operating characteristics of the cathode ray tube during or after the manufacture thereof, the use of the presser protuberance 9*c* which acts not only as a means for transmitting the elasticity of the associated leaf spring 9 to the support strip 8, but also as a spacer for providing a space between the resilient body 9*b* of the leaf spring 9 and the intermediate body 8*b* of the associated support strip 8, is advantageous in that the foreign matter will not be trapped therebetween. In view of this, the smaller the area of surface of contact between the resilient body 9*b* of each leaf spring 9 and the intermediate body 8*b* of the associated support strip 8, the better.

Another advantage brought about by the use of the line contact between the resilient body 9*b* of each leaf spring 9 and the intermediate body 8*b* of the associated support strip 8 is that the frictional resistance between them can be reduced very considerably, thereby facilitating the mounting of the shadow mask assembly as a whole to the faceplate.

Figure 1:
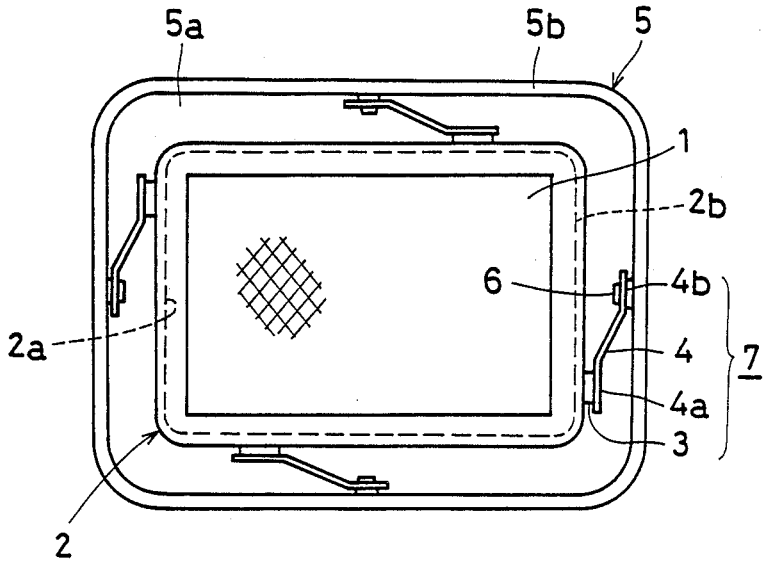
Fig. 1 Prior Art
FIG. 1 is a schematic rear elevational view of the faceplate supporting the shadow mask assembly according to the prior art shadow mask support system.

In the foregoing embodiment shown in and described with reference to FIG. 6, no bimetal piece such as identified by 3 in FIG. 1 in connection with the prior art shadow mask mounting system is employed. Instead, therefor, the resilient members 9 are employed. This is because, according to the present invention the shadow mask 1, the support frame 2 and the support strips 8 are all made of the metallic material of low coefficient of thermal expansion. Therefore, the thermal expansion may not be compensated for by the use of the bimetal pieces such as necessitated in the prior art shadow mask mounting system.

However, where a tendency of the faceplate to undergo a thermal expansion as a result of the increase of the ambient temperature within the evacuated envelope poses a problem, the bimetal piece 3 may be employed and interposed between the connecting end 9*a* of each leaf spring 9 and the axial flange 2*a* of the support frame 2 as shown in FIG. 6. This occurs so as to substantially eliminate the problem associated with the thermal expansion of the faceplate.

In any one of the foregoing embodiments, in connecting each leaf spring 9 to the support frame 2, the connecting end 9*a* of the respective leaf spring 9 has been shown and described as welded to the axial flange 2*a* of the support frame 2 with or without the use of the associated bimetal piece 3 on the one hand and to the first arm 8*a* of the associated support strip 8 on the other hand, while the resilient body 9*b* extends generally parallel to the intermediate body 8*b*. However, each support strip 8 and the associated leaf spring 9 may be connected separately to the support frame 2 as shown in any one of FIGS. 7 and 8.

According to the embodiment shown in FIG. 7, each support strip 8 is secured to the support frame 2 with the first arm 8a welded directly to the axial flange 2a of the support frame 2. The associated leaf spring 9 having the connecting end 9a and the presser protuberance 9c is positioned within a space delineated between the axial flange 2a of the support frame 2 and the support strip 8. It is secured to the support frame 2 with the connecting end 9a welded directly to the axial flange 2a of the support frame 2 at a location spaced from the site of connection between the first arm 8a of the support strip 8 and the axial flange 2a of the support frame 2. In this arrangement, the presser protuberance 9c is held in contact with that portion of the intermediate body 8b of the associated support strip 8 adjacent the second arm 8c to thereby urge the second arm 8c of the associated support strip 8 to separate away from the axial flange 2a of the support frame 2.

In the embodiment shown in FIG. 8, while each support strip 8 and the associated leaf spring 9 are secured to the support frame 2 in a manner substantially similar to that shown in and described with reference to FIG. 7. They are positioned so as to depict a generally trapezoidal shape in which, while the base of the trapezoidal shape is occupied by the axial flange 2a of the support frame 2, the top of the trapezoidal shape is occupied by the second arm 8c of the support strip 8 and the oppositely inclined sides of the trapezoidal shape are occupied respectively by the elastic body 9b of the leaf spring 9 and the intermediate body 8b of the support strip 8. In other words, each support strip 8 and the associated leaf spring 9 are so arranged as to have their bodies 8b and 9b inclined in opposite directions so as to converge at a point away from the axial flange 2a of the support frame 2 with the presser protuberance 9c engaged to the second arm 8c of the support strip 8 at a location clear from the through-hole 8d in the second arm 8c.

While in any one of the foregoing embodiments of FIGS. 5 to 8 each elastic member has been shown and descried as employed in the form of the leaf spring, it may comprise a compression spring as shown by 11 in FIG. 9.

Referring now to FIG. 9, each compression spring 11 has ends 11a and 11b opposite to each other and is mounted, in prestressed condition, between the axial flange 2a of the support frame 2 and the second arm 8c of the associated support strip 8. In practicing the embodiment of FIG. 9, at least one of the opposite ends 11a and 11b of the compression spring 11 is welded to the axial flange 2a of the support frame 2 or the second end 8c of the associated support strip 8. Also, the end 11b of the compression spring 11 which is held in contact with the second arm 8c of the associated support strip 8 is preferred to have an inner diameter slightly greater than the diameter of the associated through-hole 8d in the second arm 8c. This is so that, when the shadow mask assembly is mounted inside the space delineated by the side wall 5b of the faceplate 5 (See FIG. 1), the associated stud pin 6 (See FIG. 1) passing through the through-hole 8d can terminate, having been received within the inner diameter of the end 11b of the compression spring 11. This thereby avoids any possible displacement of the compression spring 11 relative to the through-hole 8c in the second arm 8c.

Although the present invention has fully been described in connection with the preferred embodiments thereof with reference to the accompanying drawings used only for the purpose of illustration, those skilled in the art will readily conceive numerous changes and modifications within the framework of obviousness upon the reading of the specification herein presented of the present invention. By way of example, in any one of the embodiments shown respectively in FIGS. 7 to 9, a bimetal piece similar to the bimetal piece 3 shown in FIG. 6 may, if desired or required, be employed between the first arm 8a of each support strip 8 and the axial flange 2a of the support frame 2.

Also, the number of the support strips and, hence, that of the associated elastic members, may not be always limited to four such as shown and described, but may be three or more.

Furthermore, in any one of the embodiments of FIGS. 5 to 8, instead of the use of the presser protuberance which has been described as extending across the width of the elastic body of each leaf spring so as to provide the line contact between the resilient body of each leaf spring and the intermediate body of the associated support strip, a round protuberance may be employed in the resilient body of each resilient member for providing a point contact therebetween.

Accordingly, such changes and modifications are, unless they depart from the spirit and scope of the present invention as delivered from the claims annexed hereto, to be construed as included therein.

What is claimed is:

1. A shadow mask mounting apparatus in a cathode ray tube which includes an evacuated envelope having a longitudinal axis and a funnel section closed at one end by a generally cylindrical neck section and at the other end by a faceplate of generally cup-shaped configuration, the faceplate including a screen plate, which lies generally perpendicular to the longitudinal axis, and a side wall protrudes generally parallel to the longitudinal axis and which is sealed to the funnel section, said shadow mask mounting apparatus, comprising:

a shadow mask assembly including a rigid support frame and a finely perforated shadow mask mounted across the support frame;

a plurality of generally elongated support members distributed around the support frame, each of said support members being secured at one end to the support frame and at the other end to the side wall of the faceplate;

anchoring means provided in said faceplate for anchoring said one end of each support member to the side wall of the faceplate; and a generally elongated resilient member provided for each of the support members, said resilient member for applying a biasing force, acting in a direction radially outwardly from the shadow mask, to the respective support member, said resilient member having one end secured to the support frame;

wherein said shadow mask assembly, said support frame and said support members are made of a metallic material having a coefficient of thermal expansion equal to or less than $4\times10^{-6}$/°C. and wherein the difference in coefficient of thermal expansion between the support frame and each support member is equal to or less than $2.0\times10^{-6}$/°C.

2. The shadow mask mounting apparatus as claimed in claim 1, wherein any one of either the support frames and the support members is made of a metallic alloy of low coefficient of thermal expansion containing nickel and iron as its principle components and wherein said resilient member is in the form of a leaf spring made of stainless steel.

3. The shadow mask mounting apparatus as claimed in claim 1, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to said one end of the leaf spring.

4. The shadow mask mounting apparatus as claimed in claim 1, further comprising a bimetal piece welded to the support frame, wherein said resilient member is in the form of a leaf spring having one end welded to the bimetal piece, and wherein each support member is in the form of a support strip having one end welded to said one end of the leaf spring.

5. The shadow mask mounting apparatus as claimed in claim 1, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to the support frame.

6. The shadow mask mounting apparatus as claimed in claim 5, wherein the leaf spring and the associated support strip extends away from the respective joints between said one end thereof and the support frame so as to incline in respective directions generally opposite to each other, thereby permitting the contact region of the leaf spring to be held in engagement with the associated support strip.

7. The shadow mask mounting apparatus as claimed in claim 1, wherein each of the support members is in the form of a support strip having one end welded to the support frame and wherein the resilient member comprises a coil spring interposed between the other end of the associated support member and support frame to thereby apply the biasing force to the associated support member.

8. The shadow mask mounting apparatus as claimed in claim 1, wherein said anchoring means comprises stud pins employed one for each support member and embedded in the side wall of the faceplate so as to protrude towards the support frame, and wherein the other end of each support member is formed with a throughhole for engagement with the associated stud pin.

9. A shadow mask mounting apparatus in a cathode ray tube which includes an evacuated envelope having a longitudinal axis and a funnel section closed at one end by a generally cylindrical neck section and at the other end by a faceplate of generally cup-shaped configuration, the faceplate including a screen plate, which lies generally perpendicular to the longitudinal axis, and a side wall which protrudes generally parallel to the longitudinal axis and which is sealed to the funnel section, said shadow mask mounting apparatus comprising:

a shadow mask assembly including a rigid support frame and a finely perforated shadow mask mounted across the support frame;

a plurality of generally elongated support members distributed around the support frame, each of said support members being secured at one end to the support frame and at the other end to the side wall of the faceplate;

anchoring means provided in said faceplate for anchoring said one end of each support member to the side wall of the faceplate; and a generally elongated resilient member provided for each of the support members, said resilient member for applying a biasing force, acting in a direction radially outwardly from the shadow mask, to the respective support member, said resilient member having one end secured to the support frame;

wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to said one end of the leaf spring.

10. The shadow mask mounting apparatus as claimed in claim 9, wherein said shadow mask assembly, said support frame and said support members are made of a metallic material having a coefficient of thermal expansion equal to or less than $4\times10^{-6}/°C$. and wherein the difference in coefficient of thermal expansion between the support frame and each support member is equal to or less than $2.0\times10^{-6}/°C$.

11. The shadow mask mounting apparatus as claimed in claim 9, wherein any one of either the support frames and the support members is made of a metallic alloy of low coefficient of thermal expansion containing nickel and iron as its principle components and wherein said resilient member is in the form of a leaf spring made of stainless steel.

12. The shadow mask mounting apparatus as claimed in claim 9, further comprising a bimetal piece welded to the support frame, wherein said resilient member is in the form of a leaf spring having one end welded to the bimetal piece, and wherein each support member is in the form of a support strip having one end welded to said one end of the leaf spring.

13. The shadow mask mounting apparatus as claimed in claim 9, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to the support frame.

14. The shadow mask mounting apparatus as claimed in claim 13, whererin the leaf spring and the associated support strip extends away from the respective joints between said one ends thereof and the support frame so as to incline in respective directions generally opposite to each other, thereby permitting the contact region of the leaf spring to be held in engagement with the associated support strip.

15. The shadow mask mounting apparatus as claimed in claim 9, wherein each of the support members is in the form of a support strip having one end welded to the support frame and wherein the resilient member comprises a coil spring interposed between the other end of the associated support member and the support frame to thereby apply the biasing force to the associated support member.

16. The shadow mask mounting apparatus as claimed in claim 9, wherein said anchoring means comprises stud pins employed one for each support member embedded in the side wall of the faceplate so as to protrude towards the support frame, and wherein the other end of each support member is formed with a through-hole for engagement with the associated stud pin.

17. A shadow mask mounting apparatus in a cathode ray tube which includes an evacuated envelope having a longitudinal axis and a funnel section closed at one end by a generally cylindrical neck section and at the other end by a faceplate of generally cup-shaped configuration, the faceplate including a screen plate, which lies generally perpendicular to the longitudinal axis, and a side wall which protrudes generally parallel to the longitudinal axis and which is sealed to the funnel section, said shadow mask mounting apparatus comprising:

a shadow mask assembly including a rigid support frame and a finely perforated shadow mask mounted across the support frame;

a plurality of generally elongated support members distributed around the support frame, each of said support members being secured at one end to the support frame and at the other end to the side wall of the faceplate;

anchoring means provided in said faceplate for anchoring said one end of each support member to the side wall of the faceplate;

a generally elongated resilient member provided for each of the support members, said resilient member for applying a biasing force, acting in a direction radially outwardly from the shadow mask, to the respective support member, said resilient member having one end secured to the support frame; and a bimetal piece welded to the support frame, wherein said resilient member is in the form of a leaf spring having one end welded to the bimetal piece, and wherein each support member is in the form of a support strip having one end welded to said one end of the leaf spring.

18. The shadow mask mounting apparatus as claimed in claim 17, wherein said shadow mask assembly, said support frame and said support members are made of a metallic material having a coefficient of thermal expansion equal to or less than $4\times10^{-6}/°C$. and wherein the difference in coefficient of thermal expansion between the support frame and each support member is equal to or less than $2.0\times10^{-6}/°C$.

19. The shadow mask mounting apparatus as claimed in claim 17, wherein any one of either the support frames and the support members is made of a metallic alloy of low coefficient of thermal expansion containing nickel and iron as its principle components and wherein said resilient member is in the form of a leaf spring made of stainless steel.

20. The shadow mask mounting apparatus as claimed in claim 17, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to said one end of the leaf spring.

21. The shadow mask mounting apparatus as claimed in claim 17, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to the support frame.

22. The shadow mask mounting apparatus as claimed in claim 21, wherein the leaf spring and the associated support strip extends away from the respective joints between said one ends thereof and the support frame so as to incline in respective directions generally opposite to each other, thereby permitting the contact region of the leaf spring to be held in engagement with the associated support strip.

23. The shadow mask mounting apparatus as claimed in claim 17, wherein each of the support members is in the form of a support strip having one end welded to the support frame and wherein the resilient member comprises a coil spring interposed between the other end of the associated support member and the support frame to thereby apply the biasing force to the associated support member.

24. The shadow mask mounting apparatus as claimed in claim 17, wherein said anchoring means comprises stud pins employed one for each support member and embedded in the side wall of the faceplate so as to protrude towards the support frame, and wherein the other end of each support member is formed with a through-hole for engagement with the associated stud pin.

25. A shadow mask mounting apparatus in a cathode ray tube which includes an evacuated enveloped having a longitudinal axis and a funnel section closed at one end by a generally cylindrical neck section and at the other by a faceplate of generally cup-shape configuration, the faceplate including a screen plate, which lies generally perpendicular to the longitudinal axis, and a side wall which protrudes generally parallel to the longitudinal axis and which is sealed to the funnel section, said shadow mask mounting apparatus comprising:

a shadow mask assembly including a rigid support frame and a finely perforated shadow mask mounted across the support frame;

a plurality of generally elongated support members distributed around the support frame, each of said support members being secured at one end to the support frame and at the other end to the side wall of the faceplate;

anchoring means provided in said faceplate for anchoring said one end of each support member to the side wall of the faceplate; and a generally elongated resilient member provided for each of the support members, said resilient member for applying a biasing force, acting in a direction radially outwardly from the shadow mask, to the respective support member, said resilient member having one end secured to the support frame;

wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to the support frame.

26. The shadow mask mounting apparatus as claimed in claim 25, wherein said shadow mask assembly, said support frame and said support members are made of a metallic material having a coefficient of thermal expansion equal to or less than $4\times10^{-6}/°C$. and wherein the difference in coefficient of thermal expansion between the support frame and each support member is equal to or less than $2.0\times10^{-6}/°C$.

27. The shadow mask mounting apparatus as claimed in claim 25, wherein any one of either the support frames and the support members is made of a metallic alloy of low coefficient of thermal expansion containing nickel and iron as its principle components and wherein said resilient member is in the form of a leaf spring made of stainless steel.

28. The shadow mask mounting apparatus as claimed in claim 25, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to said one end of the leaf spring.

29. The shadow mask mounting apparatus as claimed in claim 25, further comprising a bimetal piece welded to the support frame, wherein said resilient member is in the form of a leaf spring having one end welded to the bimetal piece, and wherein each support member is in the form of a support strip having one end welded to said one end of the leaf spring.

30. The shadow mask mounting apparatus as claimed in claim 25, wherein the leaf spring and the associated support strip extends away from the respective joints between said one ends thereof and the support frame so as to incline in respective directions generally opposite to each other, thereby permitting the contact region of the leaf spring to be held in engagement with the associated support strip.

31. The shadow mask mounting apparatus as claimed in claim 25, wherein each of the support members is in the form of a support strip having one end welded to the support frame and wherein the resilient member comprises a coil spring interposed between the other end of the associated support member and the support frame to thereby apply the biasing force to the associated support member.

32. The shadew mask mounting apparatus as claimed in claim 25, wherein said anchoring means comprises stud pins employed one for each support member and embedded in the side wall of the faceplate so as to protrude towards the support frame, and wherein the other end of each support member is formed with a throughhole for engagement with the associated stud pin.

33. A shadow mask mounting apparatus in a cathode ray tube which includes an evacuated envelope having a longitudinal axis and a funnel section closed at one end by a generally cylindrical neck section and at the other end by a faceplate of generally cup-shaped configuration, the faceplate including a screen plate, which lies generally perpendicular to the longitudinal axis, and a side wall which protrudes generally parallel to the longitudinal axis and which is sealed to the funnel section, said shadow mask mounting apparatus comprising:

a shadow mask assembly including a rigid support frame and a finely perforated shadow mask mounted across the support frame;

a plurality of generally elongated support members distributed around the support frame, each of said support members being secured at one end to the support frame and at the other end to the side wall of the faceplate;

anchoring means provided in said faceplate for anchoring said one end of each support member to the side wall of the faceplate; and a generally elongated resilient member provided for each of the support members, said resilient member for applying a biasing force, acting in a direction radially outwardly from the shadow mask, to the respective support member, said resilient member having one end secured to the support frame;

wherein each of the support members is in the form of a support strip having one end welded to the support frame and wherein the resilient member comprises a coil spring interposed between the other end of the associated support member and the support frame to thereby apply the biasing force to the associated support member.

34. The shadow mask mounting apparatus as claimed in claim 33, wherein said shadow mask assembly, said support frame and said support members are made of a metallic material having a coefficient of thermal expansion equal to or less than $4\times10^{-6}/°C$. and wherein the difference in coefficient of thermal expansion between the support frame and each support member is equal to or less than $2.0\times10^{-6}/°C$.

35. The shadow mask mounting apparatus as claimed in claim 33, wherein any one of either the support frames and the support members is made of a metallic alloy of low coefficient of thermal expansion containing nickel and iron as its principle components and wherein said resilient member is in the form of a leaf spring made of stainless steel.

36. The shadow mask mounting apparatus as claimed in claim 33, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to said one end of the leaf spring.

37. The shadow mask mounting apparatus as claimed in claim 33, further comprising a bimetal piece welded to the support frame, wherein said resilient member is in the form of a leaf spring having one end welded to the bimetal piece, and wherein each support member is in the form of a support strip having one end welded to said one end of the leaf spring.

38. The shadow mask mounting apparatus as claimed in claim 33, wherein said resilient member is in the form of a leaf spring having one end welded to the support frame and the other and curved to provide a contact region through which said resilient member is held in contact with the associated support member for transmitting the biasing force to such an associated support member, and wherein each support member is in the form of a support strip having one end welded to the support frame.

39. The shadow mask mounting apparatus as claimed in claim 38, wherein the leaf spring and the associated support strip extends away from the respective joints between said one ends thereof and the support frame so as to incline in respective directions generally opposite to each other, thereby permitting the contact region of the leaf spring to be held in engagement with the associated support strip.

40. The shadow mask mounting apparatus as claimed in claim 33, wherein said anchoring means comprises stud pins employed one for each support member and embedded in the side wall of the faceplate so as to protrude towards the support frame, and wherein the other end of each support member is formed with a through-hole for engagement with the associated stud pin.

41. A shadow mask mounting apparatus in a cathode ray tube which includes an evacuated envelope having a longitudinal axis and a funnel section closed at one end by a generally cylindrical neck section and at the other end by a faceplate of generally cup-shaped configuration, the faceplate including a screen plate, which lies generally perpendicular to the longitudinal axis, and a side wall which protrudes generally parallel to the longitudinal axis and which is sealed to the funnel section, said shadow mask mounting apparatus comprising:

a shadow mask assembly including a rigid support frame and a finely perforated shadow mask mounted across the support frame;

a plurality of generally elongated support members distributed around the support frame, each of said support members being secured at one end to the support frame and at the other end to the side wall of the faceplate;

anchoring means provided in said faceplate for anchoring said one end of each support member to the side wall of the faceplate; and a generally elongated resilient member provided for each of the support members, said resilient member for applying a biasing force, acting in a direction radially outwardly from the shadow mask, to the respective support member, said resilient member having one end secured to the support frame;

wherein said anchoring means includes stud pins employed one for each support member and embedded in the side wall of the faceplate so as to protrude towards the support frame, and wherein the other end of each support member is formed with a through-hole for engagement with the associated stud pin.

42. The shadow mask mounting apparatus as claimed in claim 41, wherein said shadow mask assembly, said support frame and said support members are made of a metallic material having a coefficient of thermal expansion equal to or less than $4\times10^{-6}$/°C. and wherein the difference in coefficient of thermal expansion between the support frame and each support member is equal to or less than $2.0\times10^{-6}$/°C.

43. The shadow mask mounting apparatus as claimed in claim 41, wherein any one of either the support frames and the support members is made of a metallic alloy of low coefficient of thermal expansion containing nickel and iron as its principle components and wherein said resilient member is in the form of a leaf spring made of stainless steel.

44. The shadow mask mounting apparatus as claimed in claim 41, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to said one end of the leaf spring.

45. The shadow mask mounting apparatus as claimed in claim 41, further comprising a bimetal piece welded to the support frame, wherein said resilient member is in the form of a leaf spring having one end welded to the bimetal piece, and wherein each support member is in the form of a support strip having one end welded to said one end of the leaf spring.

46. The shadow mask mounting apparatus as claimed in claim 41, wherein said resilient member is in the form of a leaf spring having one end welded to the support frame and the other end curved to provide a contact region through which said resilient member is held in contact with the associated support member for transmitting the biasing force to such an associated support member, and wherein each support member is in the form of a support strip having one end welded to the support frame.

47. The shadow mask mounting apparatus as claimed in claim 46, wherein the leaf spring and the associated support strip extends away from the respective joints between said one ends thereof and the support frame so as to incline in respective directions generally opposite to each other, thereby permitting the contact region of the leaf spring to be held in engagement with the associated support strip.

48. The shadow mask mounting apparatus as claimed in claim 41, wherein each of the support members is in the form of a support strip having one end welded to the support frame and wherein the resilient member comprises a coil spring interposed between the other end of the associated support member and the support frame to thereby apply the biasing force to the associated support member.

* * * * *